United States Patent [19]

Osawa et al.

[11] Patent Number: 4,729,294

[45] Date of Patent: Mar. 8, 1988

[54] METHOD OF OPERATING AN AIR SUPPLIED TYPE COATING BOOTH

[75] Inventors: Michiaki Osawa, Nagoya; Hidetoshi Omori, Toyota; Hidemasa Inoue; Yoshihiro Shibata, both of Seto; Hideyuki Takata, Nagoya; Yasuo Tokushima, Toyota; Shunichi Akiyama, Toyota; Masayuki Kojima, Toyota; Zyouzi Itou, Toyota, all of Japan

[73] Assignees: Trinity Industrial Corporation, Tokyo; Toyota Jidosha Kabushiki Kaisha, Toyota, both of Japan

[21] Appl. No.: 947,382

[22] Filed: Dec. 29, 1986

[30] Foreign Application Priority Data

Dec. 27, 1985 [JP] Japan ..... 60-293219

[51] Int. Cl.[4] ..... B05B 15/12

[52] U.S. Cl. ..... 98/115.2

[58] Field of Search ..... 98/115.1, 115.2, 115.3; 118/326

[56] References Cited

U.S. PATENT DOCUMENTS 4,261,256 4/1981 Joret ..... 98/115.2

4,653,387 3/1987 Osawa et al. ..... 98/115.2

FOREIGN PATENT DOCUMENTS 26359 4/1981 European Pat. Off. ..... 98/115.2

*Primary Examiner*—Harold Joyce

*Attorney, Agent, or Firm*—Cushman, Darby & Cushman

[57] ABSTRACT

A method of operating an air-supplied type coating booth in which conditioned air is enforced from an air supply blower downwardly to the inside of a coating booth and then discharged to the beneath of the booth floor by an exhaust blower, in which the booth operation is stopped after memorizing the balanced flow rates for the supply blower and the exhaust blowers kept just before the completion of the booth operation, and the supply blower and the exhaust blower are automatically set to the above-mentioned balanced flow rates respectively upon re-starting the booth operation again. Balanced and stable booth operation where no air streams flow into or out of the inlet and the exit can be attained rapidly at the start of the booth operation.

2 Claims, 3 Drawing Figures

METHOD OF OPERATING AN AIR SUPPLIED TYPE COATING BOOTH

BACKGROUND OF THE INVENTION

1. Field of the Invention

Figure 1:
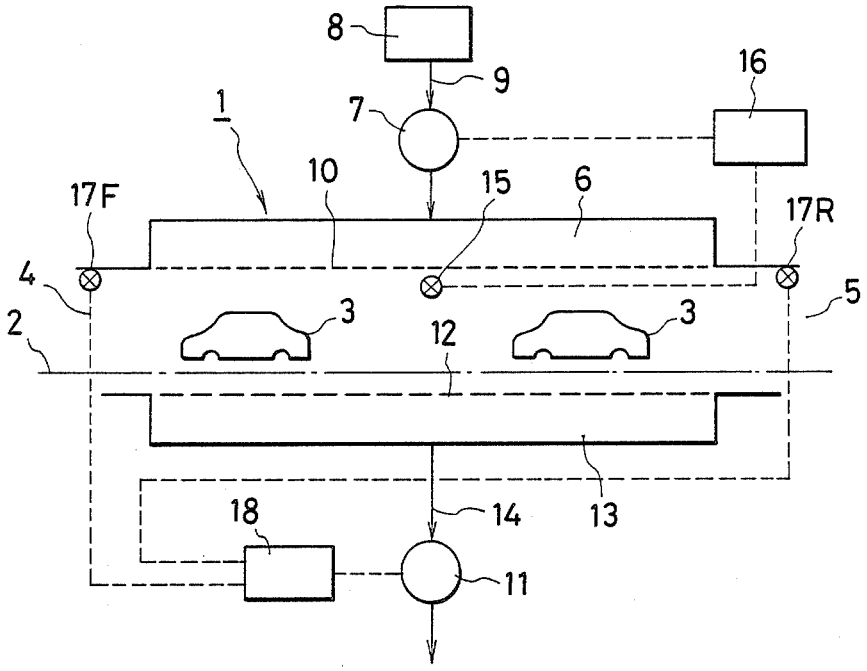

This invention concerns a method of operating an air-supplied type coating booth and, more specifically, it relates to a method of operating an air-supplied type coating booth in which conditioned air supplied from an air supply blower to a plenum chamber is enforced to the inside of a tunnel-shaped coating booth where articles to be coated such as car bodies are continuously conveyed and the air in the coating booth is drawn to exhaust together with coating mists, evaporated organic solvents and the likes by an exhaust blower to the beneath of a floor.

2. Description of the Prior Art

In an air-supplied type coating booth for use in coating in which spray coating is conducted, for example, on car bodies continuously conveyed on a conveyor, an elongate tunnel-shaped coating booth is disposed in the coating line between a pre-treatment device for coating and a drying furnace for coated articles. Clean conditioned air supplied from an air supply blower to a plenum chamber is enforced downwardly at a predetermined flow velocity into the coating booth and the air in the booth is drawn together with coating mists, evaporated organic solvent and the likes and discharged to the beneath of a floor by an exhaust blower. This downward air flow can prevent the coating mists, dusts or the likes which would otherwise give undesired effects on the coated films from scattering and drifting upwardly thereby favorably maintaining the coating quality and also keeping the health of operators who make preparation for the coating work or conduct manual spray coating in the coating booth.

By the way, if the flow rate of the conditioned air supplied as described above by the air supply blower to the plenum chamber is different from the flow rate of exhaust air drawn to discharge by the exhaust blower to the beneath of the floor of the coating booth, external air containing dusts or the likes flow through the exit and the inlet opened to both ends of the coating booth to the inside thereof thereby degrading the quality of coated articles, or contaminated air containing the coating mists, organic solvents and the likes in the coating booth flows externally and intrudes into the pre-treatment device for coating or drying furnace for coated articles disposed at the upstreamed and the downstream of the booth thereby worsening the circumstantial conditions.

In view of the above, the present inventors et.al have already proposed a method of operating an air-supplied type coating booth, which comprises detecting the flow velocity of air streams flowing into or out of the exit and the inlet opened to both ends of a tunnel-shaped coating booth, and variablly controlling the flow rate of the exhaust air discharged from the exhaust blower depending on the flow rate of air flowing into and out of the booth calculated based on the detected flow velocity, thereby maintaining the balance between the flow rate of the exhaust air and the flow rate of the supplied air to suppress the air from flowing into or out of the coating booth through the exit and the inlet thereof (U. S. patent application Ser No. 789769 filed on Oct. 21, 1985 and how allowed, entitled as "Method of operating an air feed type spray booth").

However, although the imbalance between the flow rate of air supplied from the air supply blower and the flow rate of exhaust air discharge from the exhaust blower resulted during the steady operation state of the coating booth can be effectively amended by this operation method, it still leaves a problem that it is difficult to rapidly attain a balance between the flow rate for the supplied air and the flow rate for the exhaust air thereby maintaining a stable state where the air streams flow neither into nor out of the coating booth through the exit and the inlet at the start of the booth operation by starting the air supply blower and the exhaust blower.

That is, the air supply blower and the exhaust blower have usually been operated manually upon starting the operation of the air-supplied type coating booth so as to obtain predetermined flow rates for the supplied air and the exhausted air in the conventional method. Since it is very much difficult to attain an ideal balanced state where air streams flow neither into and out of the coating booth through the exit and the inlet when the predetermined stable state is reached after starting the operation of the air supply blower and the exhaust blower. Accordingly, when the booth operation is re-started after the end of recess time or holiday, it takes an extremely long time till the a complete control is obtained in which the flow rate for the supplied air and the flow rate for the exhaust upon thereby worsening the working efficiency.

OBJECT OF THE INVENTION

Accordingly, it is an object of this invention to provide a method of operating an air supplied type coating booth capable of rapidly attaining the balance between the flow rate of air supplied from an air supply blower and the flow rate of exhaust air discharged from an exhaust blower which are started to operate at start of the booth operation and capable of automatically setting them so as to attain a stable state where air streams flow neither into and out of the coating booth through the exit and the inlet thereof.

SUMMARY OF THE INVENTION

The foregoing object of this invention can be attained in accordance with this invention by a method of operating an air-supplied type coating booth in which conditioned air supplied from an air supply blower to a plenum chamber is enforced downwardly to the inside of a tunnel-shaped coating booth and the air thus enforced in the coating booth is drawn to exhaust together with coating mists, evaporated organic solvents and the likes by an exhaust blower to the beneath of a floor by an exhaust blower, wherein the method includes:

a step of ending the operation of the coating booth comprising memorizing, the flow rate of air supplied from the air supply blower and the flow rate of exhaust air discharged from the exhaust blower attained just before the completion of the booth operation where the flow rate of the supplied air and the flow rate of the exhaust air have been balanced, and then stopping the operation for the air supply blower and the air exhaust blower and a step of re-starting the operating of the coating booth comprising automaticaly setting the flow rate of air supplied from the supply blower and the flow rate of exhaust air discharged from the exhaust blower to the flow rate of the supplied air and to the flow rate of the exhaust air memorized respectively just before the completion of the booth operation upon re-starting the booth operation again.

According to the method of this invention, since the flow rate of air supplied from the air supply blower and the flow rate of exhaust discharged from the exhaust blower at re-start of the operation of the air-supplied type coating booth are automatically set to ideal flow rates just prior to the completion of the former booth operation in which the flow rate of the supplied air and the flow rate of the exhaust air were balanced with each other in a stable state, the flow rate for the supplied air and the flow rate for exhaust air at the re-start of the booth operation can rapidly be balanced to attain a stable state where air streams flow neither into or out of the coating booth through the exit and the inlet.

BRIEF DESCRIPTION OF THE ACCOMPANYING DRAWINGS

Figure 2:
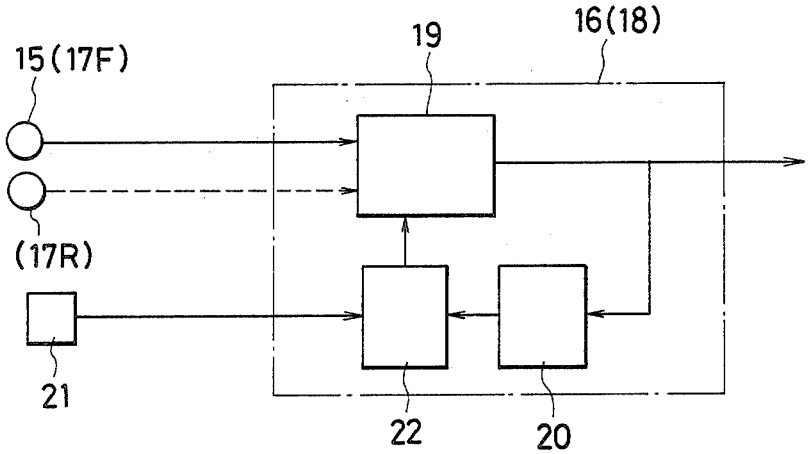
Figure 3:
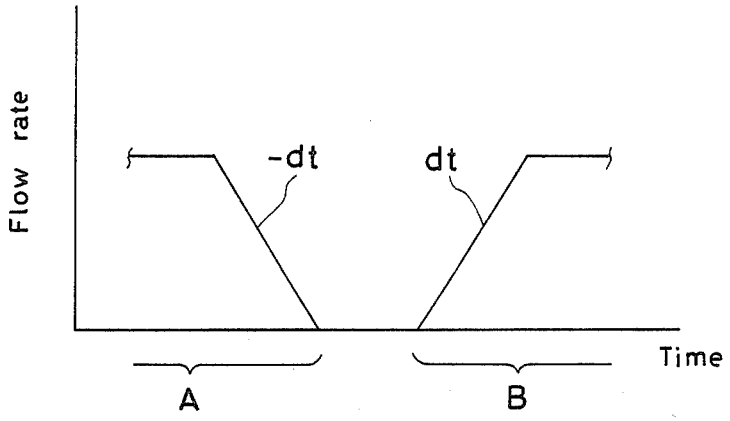

These and other objects, as well as features of this invention will become apparent by reading the following descriptions for the preferred embodiment thereof while referring to the accompanying drawings, wherein FIG. 1 is a schematic view illustrating one embodiment of an air-supplied type coating booth to which the method according to this invention is applied; and FIGS. 2 and 3 are, respectively, a block diagram and a time chart for illustrating one embodiment of the control device used for this invention.

DESCRIPTION OF REFERRED EMBODIMENT

The method according to this invention will now be described while referring to the specific embodiment shown in the drawings.

FIG. 1 is a schematic view illustrating an example of an air-supplied type coating booth using the method according to this invention.

In the drawing, coating booth 1 is formed as a tunnel-like shape for conducting spray coating to car bodies 3, 3—continuously conveyed on a floor conveyor 2 or the like. Inlet 4 and exit 5 opened at both ends of the booth 1 are communicated with a pre-treatment device disposed at the pre-stage of the coating booth 1 and a drying furnace for coated articles disposed at the succeeding stage thereof respectively (both not illustrated).

Plenum chamber 6 is disposed along the ceiling of the coating booth 1, in which conditioned air supplied from air supply blower 7 from air conditioning device 8 through air supply duct 9 to the inside of the plenum chamber 6 is enforced through filter 10 to the inside of the coating booth 1.

The conditioned air enforced to the inside of the coating booth 1 is caused to flow downwardly in the booth 1 at a uniform flow velocity of about 0.2 to 0.5 m/sec, drawn together with coating mists, evaporated organic solvent and the likes resulted in the coating booth 1 into mist processing chamber 13 below floor surface 12 by exhaust blower 11 and, after separated from and removed with the coating mists through gas-liquid contact in the mist processing chamber 13, discharged externally through exhaust duct 14. Flow velocity sensor 15 disposed just below the plenum chamber 6 is adapted to detect the flow velocity of the conditioned air supplied through the filter 10 to the inside of the coating booth 1 and adapted to output a detection signal for flow velocity to control device 16 that controls the flow rate of air supplied from the supply blower 7.

Further, flow velocity sensors 17F and 17R are disposed at the inlet 4 and the exit 5 for detecting the flow velocity of air streams that flow neither into nor out of the coating booth 1 through the inlet 4 and the exit 5 and they are adapted to output detection signals for flow velocity to control device 18 that controls the flow rate of exhaust air discharged from the exhaust blower 11.

FIG. 2 is a block diagram illustrating each one embodiment for the control devices 16 and 18.

The control device 16 (or 18) comprises operational processing section 19 for conducting a predetermined mathematical operation based on the detection signal from the flow velocity sensor 15 (or 17A, 17B) and outputting an operation signal for controlling the flow rate of air supplied from the supply blower 7 (flow rate of exhaust air discharged from the exhaust blower 11), memory section 20 for memorizing (storing) the operation signals on every time the operation signals are outputted from the operational processing section 19 and program operation section 22 for controlling the supply blower 7 (or exhaust blower 11) upon rising and falling based on the operation signals from switch 21 that starts or stops the operation of the coating booth 1.

During operation of the coating booth 1, the operation processing section 19 in the control device 16 determines the present flow velocity based on the detection signal outputted from the flow velocity sensor 15, judges if the detected flow velocity agree with a predetermined flow velocity (for instance 0.5 m/sec) or not, outputs an operation signal to the supply blower 6 so that the flow velocity of the conditioned air in the coating booth 1 is maintained at predetermined flow velocity, whereas the operational processing section 19 in the control device 18 determines the flow velocity of air streams flowing into and out of the coating booth 1 through the inlet 4 and the exit 5 based on the detected signals outputted from the flow velocity sensors 17F and 17B and outputs an operation signals to the exhaust blower 11 so as to reduce the flow velocity at the inlet 4 and the exit 5 to "0".

Signals for variably controlling the number of rotation and the angle of blade may be used, for example, to the supply blower 6 as the operation signal, while signals for controlling the number of rotation may be used for the exhaust blower 11.

In the memory section 20 of the control devices 16 and 18, the operation signals stored in the former step are updated with new operation signals on every output of the operation signals and they are stored in predetermined memory regions.

That is, the memory section 20 stores the data for the number of rotation, the angle of blade, etc. that determine the flow rate of air supplied from the supply blower 7 and the flow rate of exhaust air discharged from the exhaust blower 11 in a state where the conditioned air supplied from the air conditioning device 8 by the supply blower 7 to the plenum chamber 6 is enforced through the filter 10 to the inside of the coating booth 1 at a predetermined flow velocity of about 0.5 m/sec and the normal operation state is maintained the flow rate of air supplied from the supply blower 7 and the flow rate of exhaust air discharged from the exhaustion blower 11 are balanced to each other.

Then, when switch 21 of the coating booth 1 is turned OFF, the contents stored in each of the memory sections 20, i.e., the data determining the flow rate of the supplied air and the flow rate of the discharged exhaust just before the end of the booth operation are held and, at the same time, each of the program operation sections 22 is started to conduct the stopping for the operation of the booth while controlling the supply blower 7 and the exhaust blower 11 such that the air supply flow rate of the supplied air and the flow rate of the discharged exhaust are respectively decreased in accordance with a predetermined variation coefficient −dt.

Then, when the switch 21 is turned ON again, the operation of the supply blower 7 and the exhaust blower 11 are started. Simultaneously, each of the program operation sections 22 is actuated to control the flow rate of air supplied from the supply blower 7 and the flow rate of exhaust air discharged from the exhaust blower 11 such that they are increased in accordance with a predetermined variation coefficient dt, and they are operated at the same supplying and discharging flow rates as those in the former operation in accordance with the previous operational signals which were stored and set to the memory section 20. Then, when the operation state is settled stably after the elapse of a predetermined of time, the program operation section 22 is turned OFF and now the flow rate of air supplied from the supply blower 7 and the flow rate of exhaust air discharged from the exhaust blower 11 are controlled respectively based on the detection signals from the flow velocity sensors 15, 17A and 17B.

Explanation will be made next to the operation of the air-supplied type coating booth having been constituted as described above using the method according to this invention.

During operation of the air-supplied type coating booth, conditioned air supplied to the plenum chamber 6 by the supply blower 7 is enforced to the inside of the coating booth 1 at a predetermined flow velocity (for example, 0.5 m/sec) and, at the same time, the same flow rate of air as that supplied to the inside of the coating booth 1 is drawn to exhaust from the floor face 12 to the mist processing chamber 13.

In this state, if the flow velocity of the conditioned air flowing downwardly in the coating booth 1 is decreased, for example, due to the clogging in the filter 10 of the plenum chamber 6 etc., it may possibly cause scattering or drifting coating mists or the likes upwardly depending on the case. In such a case, the decrease in the flow velocity is detected by the flow velocity sensor 15 and an operation signal for increasing the flow rate of supplied air is outputted to the control device 16 to increase the flow velocity to a predetermined level (for example, 0.5 m/sec).

Further, if air streams flow into or out of the coating booth 1 through the inlet 4 and the exit 5 when the balance between the flow rate of air supplied from the supply blower 7 and the flow rate of exhaust air discharged from the exhaust blower 11 is lost, for example, due to the change in the number of car bodies 3, 3—conveyed, etc., the flow velocity of the air streams at the inlet 4 and the exit 5 is detected by the flow velocity sensors 17A and 17B, by which an operation signal for increasing or decreasing the flow rate of exhaust air discharged from the exhaust blower 11 is outputted from the control device 18 to maintain the balance between the flow rate of the supplied air and the flow rate of the exhaust, as well as the information for the operation signal for determining the air supply flow rate and the exhaustion flow rate stored so far in each of the memory sections 20 are updated with the newest operation signals.

If the switch 21 for the coating booth is turned ON in this state, the processing conducted so far in the operational processing section 19 is interrupted and the newest operational signals stored at that point are held in the memory section 20. At the same time, the program operation section 22 is turned ON, to interrupt the operation of the supply blower 7 and the exhaust blower 11 while decreasing the flow rate of air supplied from the supply blower 7 and the flow rate of exhaust air discharged from the exhaust blower 11 along with the predetermined variation coefficient −dt as shown in FIG. 3A.

In this way, as the flow rates for the supplied air and the exhaust air are decreased along with the predetermined variation coefficient, since the flow rates/both for the supplied and discharged airs are decreased while maintaining a balance between each of them, the air streams can surely be prevented from flowing into or out of the coating booth 1 through the inlet 4 and the exit 5 upon ending the booth operation where the operation of the supply blower 7 and that of the exhaust blower 11 are stopped.

Then, upon re-starting the operation of the air-supplied type coating booth, the switch 21 for the coating booth 1 is turned ON. Then, the program operation section 22 is actuated by the actuation signal from the switch 21 to output an operation signal for starting the operation of the supply blower 7 and the exhaust blower 11. Thus, the flow rates for the supplied air and the exhaust air are increased respectively along with a predetermined variation coefficient dt as shown in FIG. 3B, in which a stable state is attained when the operation signal outputed from the program operation section 22 agrees with the operation signal stored in the memory section 20 just before the completion of the previous booth operation, in which the blowers are operated at the flow rates depending on the operation signals stored in the memory section 20.

Specifically, the supply blower 7 and the exhaust blower 11 are automatically set, at the re-start of the booth operation, to the flow rates balanced with each other in which the air streams flow neither into nor out of the coating booth 1 through the inlet 4 and the exit 5.

Further, when the flow rate of the air supplied from the supply blower 7 and the flow rate of the exhaust air discharged from the exhaust blower 11 are increased along with the predetermined variation coefficient dt as in this embodiment, since the imbalance between the flow rates of the supplied air and the flow rated of the discharged exhaust can be suppressed upon transferring to the stable state just after the starting of the supply blower 7 and the exhaust blower 11, the balance between the flow rates for the supplied air and the flow rate for the exhaust air in the coating booth can be reached more rapidly. Since usual blowers can not be controlled in a stepless manner from "0" to a maximum capacity, but controlled variably within a range from a minimum to a maximum capacity thereof, if the minimum capacity is different between the supply blower 7 and the exhaust blower 11 the blower of a smaller minimum capacity may be controlled following after the blower of a greater minimum capacity.

Then, after the elapse of a sufficient time (about 5 minutes) to reproduce the flow rates for the supplied air and for the exhaust air at the completion of the former booth operation after the switch 21 has been turned ON, the program operation section 22 is turned OFF and the processing in the operational processing section 19 is started, in which the flow rate of the air supplied from the supply blower 7 and the flow rate of exhaust air discharged from the exhaust blower 11 are variably controlled in accordance with predetermined operational processing based on the detection signals from the flow valocity sensors 15, 17A and 17B.

Then, when the switch 21 for the coating booth 1 is turned OFF at the end of the booth operation, the processing in the operation processing section 19 is interrupted and the operational signals stored at that time are held in the memory section 20. At the same time, the program operation section 22 is turned ON, by which the flow rate of the air supplied from the supply blower 7 and the flow rate of the exhaust air discharged from the exhaust blower 11 are decreased along with the predetermined variation coefficient $-dt$ as shown in FIG. 3A, till the operation of the supply blower 7 and the exhaust blower 11 are interrupted.

As has been described above by the method according to this invention, since the flow rate of the air supplied from the supply blower and the flow rate of the exhaust air discharged from the exhaust blower started to operate at the start of the operation of the air-supply type coating booth are automatically set so as to attain the balance with each other under the same condition as those attained just before the end of the former booth operation, a stable state, in which the air streams flow neither into nor out of the coating booth through the inlet and the exit thereof, can be obtained rapidly upon re-starting of the booth operation.

What is claimed is:

1. A method of operating an air-supplied type coating booth in which conditioned air supplied from an air supply blower to a plenum chamber is enforced downwardly to the inside of a tunnel-shaped coating booth and the air thus enforced in the coating booth is drawn to discharge together with coating mists, evaporated organic solvents and the likes by an exhaust blower to the beneath of a floor, wherein the method includes:

a step of ending the operation of the coating booth comprising memorizing the flow rate of air supplied from the air supply blower and the flow rate of exhaust air discharged from the exhaust blower attained just before the completion of the booth operation where the flow rate of the supplied air and the flow rate of the exhaust air have been balanced, and then stopping the operation for the air supply blower and the air exhaust blower and a step of re-starting the operation of the coating booth comprising automatically setting the flow rate of air supplied from the supply blower and the flow rate of exhaust air discharged from the exhaust blower to the flow rate of the supplied air and to the flow rate of the exhaust air memorized respectively just before the completion of the booth operation upon re-starting the booth operation again.

2. A method of operating an air-supplied type coating booth as defined in claim 1, wherein the flow rate for the air supplied from the air supply blower and that for the exhaust air discharged from the exhaust blower are memorized before the completion of the booth operation and the air supply blower and the exhaust blower are operated in accordance with the memorized flow rate upon re-starting of the booth operation in a program-controlled manner respectively.

* * * * *